US012507860B2

(12) United States Patent
Frank et al.

(10) Patent No.: US 12,507,860 B2
(45) Date of Patent: Dec. 30, 2025

(54) DOMESTIC DISHWASHER

(71) Applicant: BSH Hausgeräte GmbH, Munich (DE)

(72) Inventors: Erwin Frank, Binswangen (DE); Stefan Würth, Bachhagel / Burghagel (DE)

(73) Assignee: BSH Hausgeräte GmbH, Munich (DE)

( * ) Notice: Subject to any disclaimer, the term of this patent is extended or adjusted under 35 U.S.C. 154(b) by 141 days.

(21) Appl. No.: 18/682,159

(22) PCT Filed: Sep. 5, 2022

(86) PCT No.: PCT/EP2022/074564

§ 371 (c)(1),
(2) Date: Feb. 8, 2024

(87) PCT Pub. No.: WO2023/046444

PCT Pub. Date: Mar. 30, 2023

(65) Prior Publication Data

US 2024/0349975 A1 Oct. 24, 2024

(30) Foreign Application Priority Data

Sep. 22, 2021 (DE) ..... 102021210560.2

(51) Int. Cl.
*A47L 15/42* (2006.01)
*A47L 15/44* (2006.01)

(52) U.S. Cl.
CPC ..... *A47L 15/4409* (2013.01); *A47L 15/4257* (2013.01)

(58) Field of Classification Search
None
See application file for complete search history.

(56) References Cited

U.S. PATENT DOCUMENTS 7,337,635 B2 3/2008 Cerruti
2003/0188768 A1* 10/2003 Cerruti ..... A47L 15/4409 134/57 D (Continued)

FOREIGN PATENT DOCUMENTS

AT 356320 B 4/1980
EP 0893091 A2 1/1999

OTHER PUBLICATIONS

National Search Report DE 10 2021 210 560.2 dated Jun. 1, 2022.
International Search Report PCT/EP2022/074564 dated Dec. 8, 2022.

*Primary Examiner* — Levon J Shahinian
(74) *Attorney, Agent, or Firm* — Michael E. Tschupp; Andre Pallaies; Brandon G. Braun

(57) ABSTRACT

A household dishwasher includes a dishwasher cavity encompassing a dishwasher interior, and a dispensing facility designed to dispense a cleaning agent into the dishwasher interior. The dispensing facility has a receiving part including a receiving area for receiving the cleaning agent. A cover seals the receiving area. A sealing arrangement has at least one section arranged between the receiving part and the cover. The sealing arrangement includes a first sealing lip and a second sealing lip that is different from the first sealing lip. The sealing arrangement runs completely around the receiving area, with the first sealing lip running only partially around the receiving area, and the second sealing lip also running only partially around the receiving area.

17 Claims, 4 Drawing Sheets

(56) References Cited

U.S. PATENT DOCUMENTS

| | | | |
|---|---|---|---|
| 2012/0090643 | A1 | 4/2012 | Bertsch |
| 2012/0138101 | A1 | 6/2012 | Francisco |
| 2019/0104914 | A1 | 4/2019 | Detko |

* cited by examiner

DOMESTIC DISHWASHER

CROSS-REFERENCES TO RELATED APPLICATIONS

This application is the U.S. National Stage of International Application No. PCT/EP2022/074564, filed Sep. 5, 2022, which designated the United States and has been published as International Publication No. WO 2023/046444 A1 and which claims the priority of German Patent Application, Serial No. 10 2021 210 560.2, filed Sep. 22, 2021, pursuant to 35 U.S.C. 119(a)-(d).

The contents of International Application No. PCT/EP2022/074564 and German Patent Application, Serial No. 10 2021 210 560.2 are incorporated herein by reference in their entireties as if fully set forth herein.

BACKGROUND OF THE INVENTION

The present invention relates to a household dishwasher.

A dishwasher comprises a dishwasher cavity which can receive items to be washed for cleaning. A door is rotatably attached to the dishwasher cavity in order to close and open the dishwasher cavity. The door can be provided with a dispensing facility which is configured so as to release a cleaning agent during a dishwashing program of the dishwasher.

BRIEF SUMMARY OF THE INVENTION

US 2019/0104914 A1 describes a previously mentioned dispensing facility for a dishwasher. The dispensing facility comprises a receiving part for receiving a cleaning agent and a cover which can be moved from an open state into a closed state and conversely. After the receiving part has been filled with the cleaning agent, the cover is moved from the open state into the closed state. In order to release the cleaning agent, the cover opens during the operation of the dishwasher.

Based on this background, it is an object of the present invention to provide an improved household dishwasher.

Accordingly, a household dishwasher having a dishwasher cavity, which encompasses a dishwasher interior of the household dishwasher, and having a dispensing facility for dispensing a cleaning agent into the dishwasher interior is proposed. In this case, the dispensing facility has a receiving part having a receiving area for receiving the cleaning agent, a cover for closing the receiving area and a sealing arrangement that is arranged at least in sections between the receiving part and the cover, wherein the sealing arrangement has a first sealing lip and a second sealing lip which is different from the first sealing lip, wherein the sealing arrangement runs completely around the receiving area, wherein the first sealing lip runs only partially around the receiving area, and wherein the second sealing lip also runs only partially around the receiving area.

The sealing arrangement therefore has an interrupted rather than a closed sealing contour due to the two sealing lips being different from each other, which means that reliable functioning of the dispensing facility can be achieved with low operating forces of the cover and at the same time a secure seal.

The dishwasher cavity is preferably cuboid or box-shaped. The dishwasher interior is provided within the dishwasher cavity. The dishwasher interior can be surrounded or encompassed by the dishwasher cavity and a door that is attached to the dishwasher cavity. The dishwasher cavity and where appropriate the door thus define the limits or the spatial extent of the dishwasher interior. The dispensing facility can also be described as dispenser, release facility, dosing facility, detergent dosing device, detergent dispenser, dispenser chamber, dosing facility or dosing chamber.

The dispensing facility is configured so as to receive and dispense the cleaning agent in tablet form, powder form or as a liquid. By way of example, the dispensing facility can be filled manually with the cleaning agent. The dispensing facility then automatically dispenses the cleaning agent during a washing process of the household dishwasher so that the cleaning agent can dissolve in the dishwasher interior in the wash liquor and/or fresh water in order to clean items to be washed that have been received in the dishwasher interior.

It is preferred that the receiving part is attached to the previously mentioned door. However, the receiving part can also be attached to the dishwasher cavity, for example to a side wall of the dishwasher cavity. The receiving part is preferably a plastic component, in particular a plastic injection molded component. The receiving area is formed as one with the receiving part. It is preferred that the receiving area is tub-shaped or trough-shaped and can receive the cleaning agent. The receiving area can be closed or opened with the aid of the cover and thus moved from an open state into a closed state and conversely. For this purpose, the cover can be pivotably attached to the receiving part. However, the cover can also be displaceably mounted on the receiving part in order to open and again close the receiving area.

The sealing arrangement is provided between the receiving part and the cover. In this case, the sealing arrangement can, however, also protrude beyond the receiving part and/or the cover. In particular, the scaling arrangement lies against a flange of the receiving part, said flange running around the receiving area. The sealing arrangement can be fixedly connected to the receiving part. The sealing arrangement is preferably produced from an elastic deformable material. By way of example, it is possible to use silicone, rubber, polyurethane or a thermoplastic elastomer (TPE), in particular a thermoplastic polyurethane (TPU), for the sealing arrangement. The material that is used for the sealing arrangement can be foamed. The material can be compressible.

The fact that the first sealing lip and the second sealing lip "are different" from each other means in the present case in particular that the first sealing lip and the second sealing lip are two sections or areas of the sealing arrangement which are separate from each other, in particular spatially, and preferably do not contact each other and/or are not in contact with each other. However, this does not exclude the fact that the sealing lips are connected to each other with the aid of a connecting section. The sealing arrangement thus has an open or interrupted sealing geometry or sealing contour rather than a closed sealing geometry or sealing contour. In the present case, "scaling geometry" or "sealing contour" is understood to be a geometry or contour, in other words an outline, of the sealing arrangement with which in the closed state the sealing arrangement lies against the cover.

The sealing arrangement itself runs with the two sealing lips together completely around the receiving area. In other words, the receiving area is arranged within the sealing arrangement which runs completely around the receiving area or encompasses it. In this case, the first sealing lip and the second sealing lip, however, only or only in part run around the receiving area. "Only" in this context means that the respective sealing lip does not run completely around the receiving area. In other words, the first sealing lip and the second sealing lip each have an open rather than a closed sealing geometry or sealing contour. In this case, the first sealing lip and the second sealing lip are, however, arranged in such a manner that together they form the sealing arrangement that completely runs around the receiving area.

In accordance with one embodiment, the first sealing lip and the second sealing lip overlap each other in an overlap area when viewed along a transverse direction, wherein the overlap area can be arranged in particular in a variable manner.

The transverse direction is assigned in particular to the previously mentioned door. The transverse direction can also be assigned to the dispensing facility itself. It is preferred that the door is assigned the transverse direction or x-direction, a vertical direction or y-direction and a downward direction or z-direction. The directions are oriented in a perpendicular manner with respect to one another. The directions form a system of coordinates. The previously mentioned system of coordinates with the three directions can also be assigned to the dispensing facility itself. It is preferred that the door has a plate-shaped geometry which extends essentially along the transverse direction and the vertical direction. "Essentially" in this case means that the geometric extents of the door in the transverse direction and in the vertical direction are many times greater than in the downward direction. By way of example, the door has a thickness of a few centimeters along the downward direction. When viewed along the downward direction, the dispensing facility, in particular the receiving area having the cover, partially protrudes beyond the door and into the dishwasher interior. It is preferred that a first overlap area is provided, in which the first sealing lip and the second sealing lip overlap, and a second overlap area in which the first sealing lip and the second sealing lip also overlap. In the present case, "overlap" or "overlay" mean that the first sealing lip and the second sealing lip are positioned one above the other or overlay each other when viewed along the transverse direction. The fact that the overlap area can be "variably arranged" means in the present case in particular that the overlap area can be positioned or arranged as desired when viewed along the vertical direction.

In accordance with a further embodiment, the first sealing lip is wider than the second sealing lip when viewed along the transverse direction.

The first sealing lip can thus protrude on both sides beyond the second sealing lip when viewed along the transverse direction. As a result, the first sealing lip overlays the second sealing lip when viewed in the vertical direction.

In accordance with a further embodiment, the first sealing lip covers the second sealing lip in a roof-shaped manner when viewed along the vertical direction.

This ensures that any liquid, in particular wash liquor and/or fresh water, which impinges against the first sealing lip is channeled around the second sealing lip. This reliably prevents liquid from penetrating into the receiving area. The vertical direction is assigned to the door or the dispensing facility itself.

In accordance with a further embodiment, the second sealing lip is arranged at least in sections within the first sealing lip when viewed along the transverse direction.

This means that the first sealing lip preferably encompasses or encloses the second sealing lip when viewed along the transverse direction. In this case, however, the second sealing lip can protrude beyond the second sealing lip or can protrude from it.

In accordance with a further embodiment, the first sealing lip has a base section that extends along the transverse direction, a first leg section which extends transversely to the base section and a second leg section which also extends transversely to the base section, wherein the second sealing lip has a base section that extends along the transverse direction, a first leg section which extends transversely to the base section and a second leg section which also extends transversely to the base section.

In the present case "transversely" means in particular any angle not equal to 0°. This means that the leg sections and the base section that is assigned to said leg sections are not arranged parallel to each another. "Transversely" includes primarily in particular an angle between the base section and the respective leg section of 90°±20°, preferred of 90°±10°, further preferred of 90°±5°, further preferred of 90°±3°, further preferred of 90°±1°, further preferred of precisely 90°. In other words, transversely can also mean perpendicular or orthogonal. The terms "transversely" and "perpendicular" can therefore be interchanged with each other. When viewed along the transverse direction, the base section of the first sealing lip is in particular wider that the base section of the second sealing lip. It is preferred that the leg sections run along the vertical direction.

In accordance with a further embodiment, the two leg sections of the second sealing lip are arranged between the two leg sections of the first sealing lip when viewed along the transverse direction.

This means in particular that the two leg sections of the second sealing lip are positioned closer together than the two leg sections of the first sealing lip when viewed along the transverse direction. The two leg sections of the first sealing lip are consequently arranged outside the two leg sections of the second sealing lip.

In accordance with a further embodiment, the two first leg sections of the sealing lips overlap at least in sections when viewed along the transverse direction, wherein the two second leg sections of the sealing lips overlap at least in sections when viewed along the transverse direction.

In particular, the two first leg sections of the sealing lips overlap in the previously mentioned overlap area. Accordingly, the two second leg sections of the sealing lips overlap in the second overlap area.

In accordance with a further embodiment, a gap, in particular an air gap, is provided at least in sections between the first sealing lip and the second sealing lip.

This means in particular that an intermediate space is provided between the first lip and the second lip. In particular, one gap is provided between the two first leg sections of the sealing lips and a further gap is provided between the two second leg sections of the sealing lips, respectively. In each case, a gap is formed in particular at the two overlap areas.

In accordance with a further embodiment, the first sealing lip, the second sealing lip and the gap together form a labyrinth seal of the sealing arrangement.

In the present case, a "labyrinth seal" or "gap seal" is to be understood to be a non-contact seal in which the sealing lips do not touch each other and are therefore not in contact with each other. The sealing effect of the labyrinth seal is based on an extension of a flow path of a fluid, for example wash liquor and/or fresh water or a liquid cleaning agent, through the gap that is to be sealed, which significantly increases the flow resistance for the fluid that is entering or leaving the dispensing facility. The extension of the flow path is achieved by an interlocking, as explained above, or an intermeshing of the two sealing lips. This interlocking of the two sealing lips is realized in particular only in the previously mentioned overlap areas.

In accordance with a further embodiment, the first sealing lip has a U-shaped geometry, wherein the second sealing lip also has a U-shaped geometry, and wherein the first sealing lip and the second sealing lip are arranged in such a manner that the U-shaped geometries are arranged in opposite directions and at least in sections one inside the other.

The respective U-shaped geometry is formed with the aid of the base section and the leg sections that are arranged transversely to the base section. The two U-shaped geometries of the sealing lips are arranged in such a manner that one of the U-shaped geometries is arranged inversely, so that the two U-shaped geometries are arranged at least in sections one inside the other or interlocked. "Inversely" in this context means in particular that one of the U-shaped geometries is positioned upside down or inverted compared to the other U-shaped geometry.

In accordance with a further embodiment, the cover is mounted on the receiving part in such a manner that the dispensing facility can be moved from a closed state into an open state and conversely, wherein the sealing arrangement is compressed between the receiving part and the cover in the closed state.

The cover can, for example, be mounted on the receiving part in such a manner that the cover can pivot about an axis of rotation. Alternatively, the cover can be mounted in a linear displaceable manner on the receiving part. In the present case, "compressed" is to be understood to mean that the sealing arrangement is reversibly deformed in the closed state compared to the open state.

In accordance with a further embodiment, the sealing arrangement has a connecting section, wherein the first sealing lip is only connected to the second sealing lip in one piece, in particular in one piece of material, with the aid of the connecting section.

"One-piece" or "one-part" means in this case that the sealing lips and the connecting section form a common component and are not made from different components. "One-piece material" means in this case in particular that the sealing arrangement is produced continuously from the same material. The sealing arrangement can be a plastic component, in particular a plastic injection molded component. The sealing arrangement can be injected, for example, with the aid of a multi-component injection molded method, onto the receiving part.

In accordance with a further embodiment, the household dishwasher comprises a door that is attached to the dishwasher cavity, wherein the dispensing facility is attached to the door facing the dishwasher interior.

By way of example, the door is mounted on the dishwasher interior in such a manner that the door can pivot about a pivot axis. However, this is not absolutely necessary. "Facing" the dishwasher interior means in the present case in particular that the dispensing facility faces the dishwasher interior and is provided on the inside of the door.

In accordance with a further embodiment, the dispensing facility protrudes at least in part into the dishwasher interior when the door is in a closed state.

In particular, the cover and a part of the receiving part protrude into the dishwasher interior. The receiving part can be received at least in sections within the door. The dispensing facility can be provided centrally on the door when viewed along the transverse direction. Alternatively, the dispensing facility can also be arranged offset with respect to the center of the door when viewed along the transverse direction. When viewed along the vertical direction, the dispensing facility is preferably positioned in an upper third of the door. In particular, the dispensing facility is arranged in an area of an upper edge of the door. The upper edge of the door is preferably facing away from the previously mentioned pivot axis of the door. The pivot axis is provided in particular on a lower edge of the door.

Further possible implementations of the household dishwasher also comprise combinations, not explicitly mentioned, of features or embodiments which are described above or below with regard to the exemplary embodiments. In this case, the person skilled in the art will also add individual aspects as improvements or supplements to the respective basic form of the household dishwasher.

BRIEF DESCRIPTION OF THE DRAWINGS

Further advantageous embodiments and aspects of the household dishwasher are the subject of the subordinate claims and the exemplary embodiments of the household dishwasher that are described below. Furthermore, the household dishwasher is described in detail with the aid of preferred embodiments with reference to the attached figures.

DETAILED DESCRIPTION OF EXEMPLARY EMBODIMENTS OF THE PRESENT INVENTION

Figure 1:
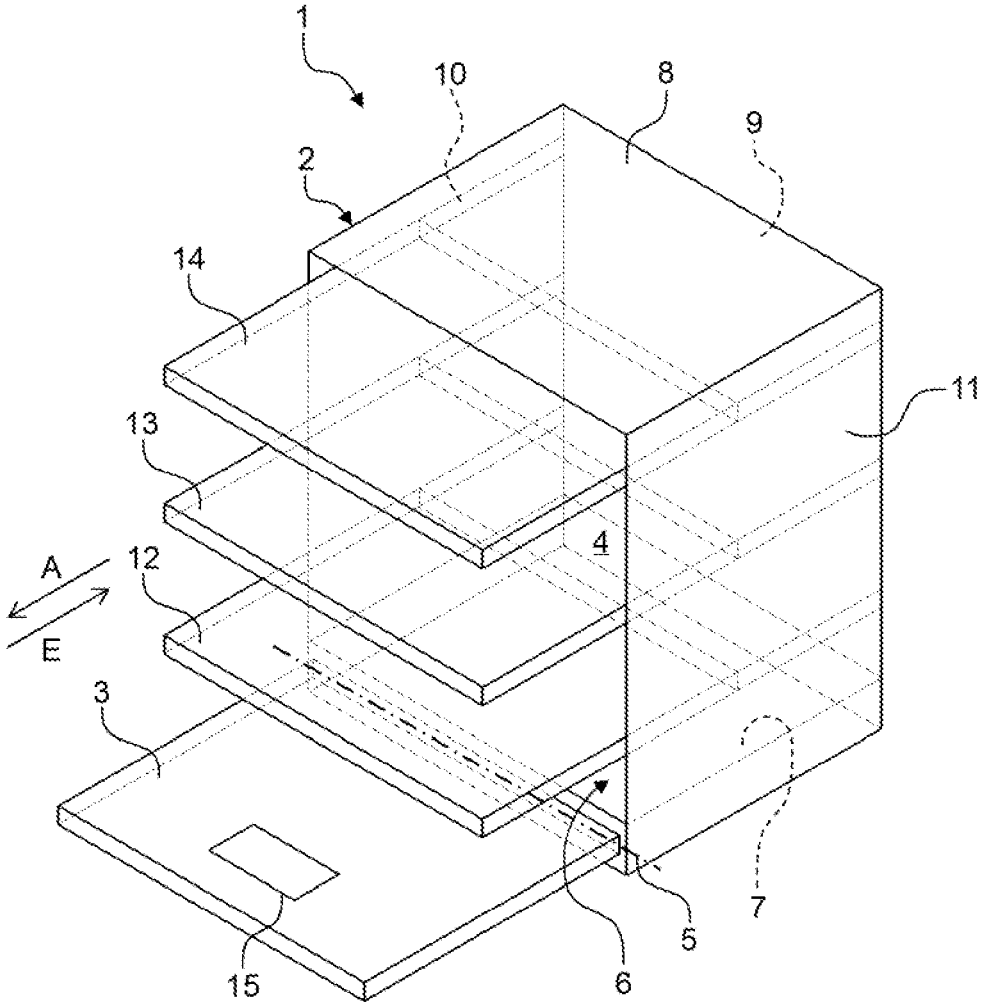
FIG. 1 shows a schematic perspective view of an embodiment of a household dishwasher.

Identical or identically functioning elements are provided in the figures with the same reference characters, unless otherwise indicated.

FIG. 1 shows a schematic perspective view of an embodiment of a household dishwasher 1. The household dishwasher 1 comprises a dishwasher cavity 2 which can be sealed, in particular in a water-tight manner, by a door 3. For this purpose, a sealing facility can be provided between the door 3 and the dishwasher cavity 2. The dishwasher cavity 2 is preferably cube-shaped. The dishwasher cavity 2 can be arranged in a housing of the household dishwasher 1. The dishwasher cavity 2 and the door 3 can form a dishwasher interior 4 for washing items to be washed.

The door 3 is illustrated in FIG. 1 in its open position. The door 3 can be closed or opened by pivoting about a pivot axis 5 that is provided at a lower end of the door 3. A loading opening 6 of the dishwasher cavity 2 can be closed or opened with the aid of the door 3. The dishwasher cavity 2 has a base 7, a cover 8 that is arranged opposite the base 7, a rear wall 9 that is arranged opposite the closed door 3 and two side walls 10, 11 that are arranged opposite each other. The base 7, the cover 8, the rear wall 9 and the side walls 10, 11 can be produced, for example, from a stainless steel sheet. Alternatively, by way of example, the base 7 can be produced from a plastic material.

Moreover, the household dishwasher 1 has at least one receptacle 12 to 14 for items to be washed. It is preferred that multiple, for example three, receptacles 12 to 14 for items to be washed can be provided, wherein the receptacle 12 for items to be washed can be a lower receptacle for items to be washed or a lower basket, the receptacle 13 for items to be washed can be an upper receptacle for items to be washed or an upper basket and the receptacle 14 for items to be washed can be a cutlery drawer. Furthermore, as shown in FIG. 1, the receptacles 12 to 14 for items to be washed are arranged one above the other in the dishwasher cavity 2. Each receptacle 12 to 14 for items to be washed can be displaced into or out of the dishwasher cavity 2 as desired. In particular, each receptacle 12 to 14 for items to be washed can be pushed or moved into the dishwasher cavity 2 in an insertion direction E or pulled out or moved out of the dishwasher cavity 2 in a pull-out direction A opposite the insertion direction E.

A dispensing facility 15 for receiving and dispensing a cleaning agent in tablet form, powder form or as a liquid is provided on the inside of the door 3. "On the inside" means in this case facing the dishwasher interior 4. The dispensing facility 15 can be filled manually with the cleaning agent. The dispensing facility 15 then automatically dispenses the cleaning agent during a washing process of the household dishwasher 1, so that the cleaning agent can dissolve in the dishwasher interior 4 in the wash liquor and/or fresh water in order to clean items to be washed that have been received in the dishwasher interior 4.

The dispensing facility 15 can also be described as dispenser, release facility, dosing facility, detergent dosing device, detergent dispenser, dispenser chamber, dosing facility or dosing chamber. The above-mentioned terms for the dispensing facility 15 can be interchanged with one another as desired. In a closed state (not shown) of the door 3, the dispensing facility 15 protrudes at least in sections into the dishwasher interior 4. The dispensing facility 15 can be positioned at least in sections within the door 3. The dispensing facility 15 thus protrudes out of the door 3.

Figure 2:
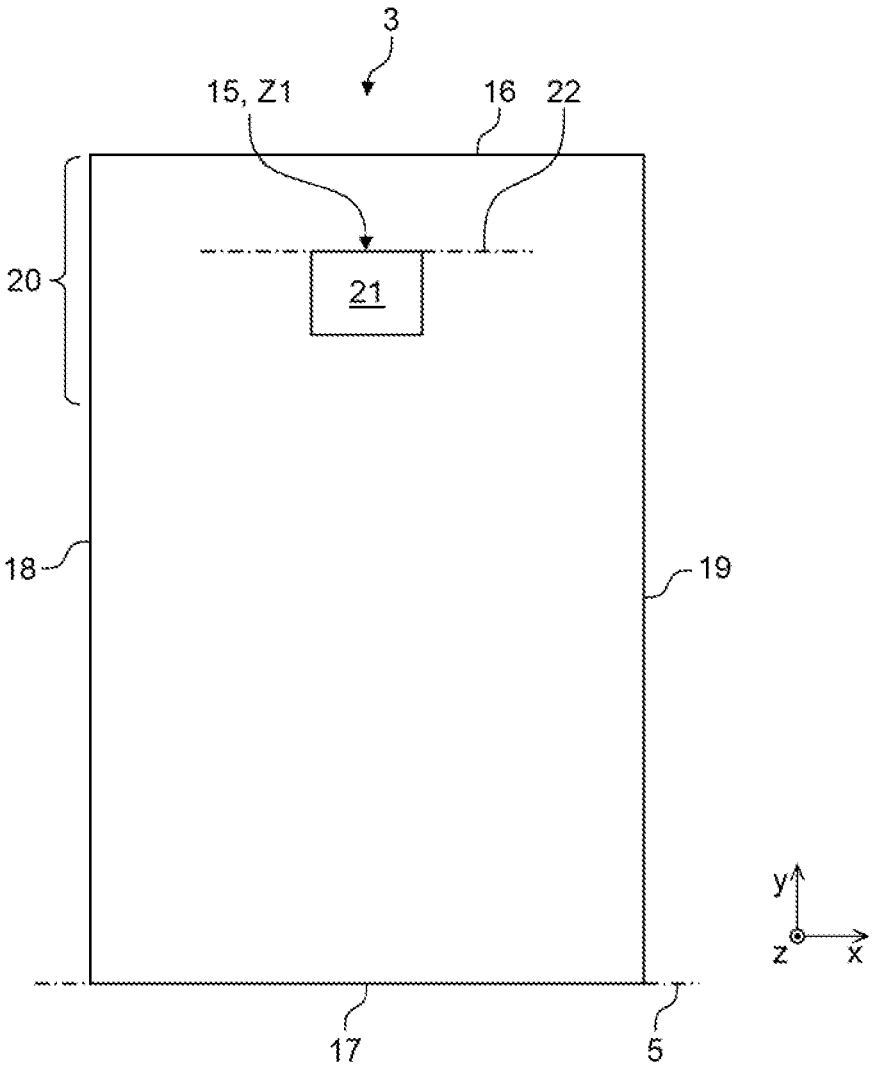
FIG. 2 shows a schematic view of an embodiment of a door for the household dishwasher shown in FIG. 1.

FIG. 2 shows a schematic view of an embodiment of a door 3 as previously explained. The door 3 is assigned a system of coordinates with a first spatial direction, transverse direction or x-direction x, a second spatial direction, vertical direction or y-direction y and a third spatial direction, downward direction or z-direction z. The directions x, y, z are oriented in a perpendicular manner with respect to one another.

The dispensing facility 15 is provided on an upper edge 16 of the door 3. The previously mentioned system of coordinates with the three directions x, y, z can also be assigned to the dispensing facility 15. The pivot axis 5 is provided on a lower edge 17 of the door 3. The y-direction y is orientated from the lower edge 17 in the direction of the upper edge 16. The dispensing facility 15 is arranged between the upper edge 16 and the lower edge 17, wherein the dispensing facility 15 is preferably attached with regard to the upper edge 16 and the lower edge 17 in an upper area of the door 3 in the orientation shown in FIG. 2.

In the horizontal direction, in other words viewed along the x-direction x, the dispensing facility 15 is positioned between a first side edge 18 and a second side edge 19 of the door 3. In this case, the dispensing facility 15 can be positioned centrally between the side edges 18, 19 or laterally offset with respect to one of the side edges 18, 19. The x-direction x is orientated from the first side edge 18 in the direction of the second side edge 19. In particular, the dispensing facility 15 is positioned in an upper third 20 of the door 3.

The dispensing facility 15 comprises a movable cover 21 which can be opened and closed so as to introduce the cleaning agent. During the wash program of the household dishwasher 1, the cover 21 is automatically opened in order to release the cleaning agent that has been received into the dispensing facility 16 into the dishwasher interior 4. For this purpose, the cover 21 can be rotatably mounted about an axis of rotation 22 in order to move said cover from a closed state Z1 shown in FIG. 2 into an open state and conversely.

Alternatively, the cover 21 can also be displaceably mounted so that said cover can be pushed back and forth so as to open and close sideward, in other words between the side edges 18, 19, or vertically, in other words between the upper edge 16 and the lower edge 17. The cover 21 can be a plastic component, in particular a plastic injection molded component.

Figure 3:
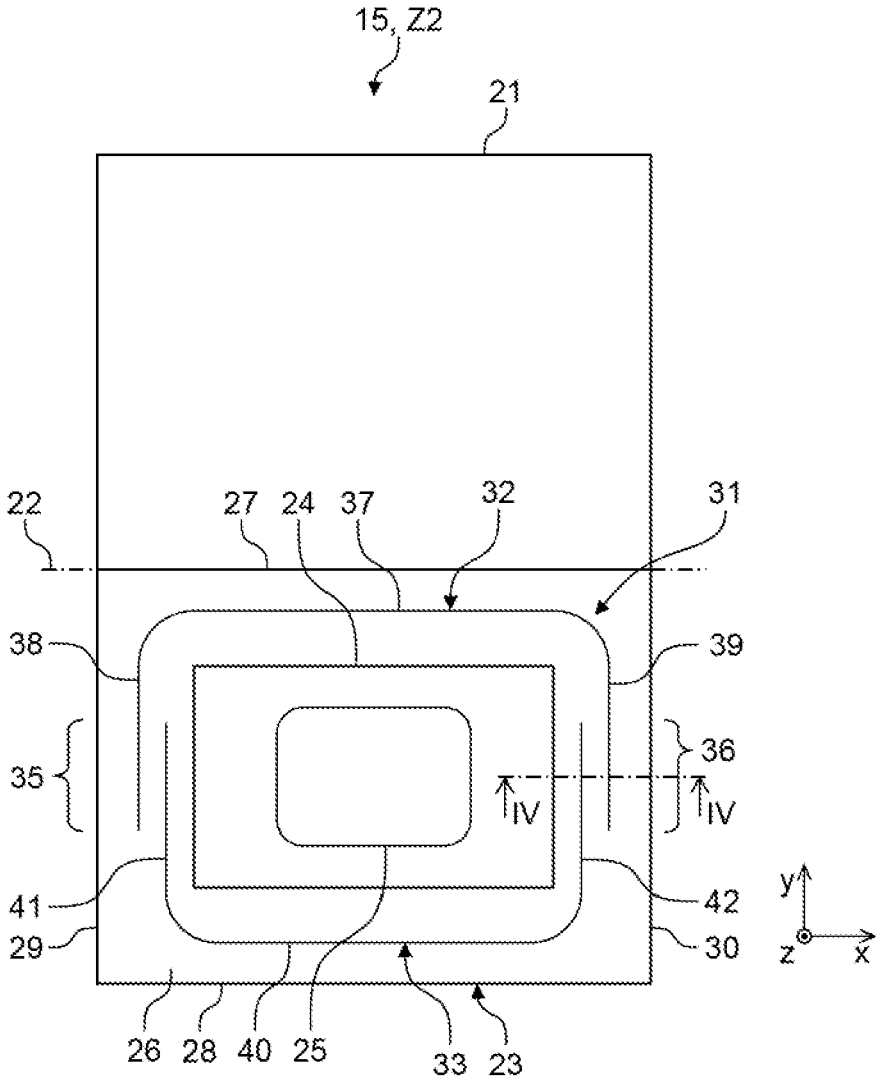
FIG. 3 shows a schematic view of an embodiment of a dispensing facility for the household dishwasher shown in FIG. 1.

FIG. 3 shows a view of one embodiment of a previously mentioned dispensing facility 15 in a previously mentioned open state Z2. In the orientation shown in FIG. 3, the upper edge 16 is positioned above the dispensing facility 15 and the lower edge 17 is positioned below the dispensing facility 15. In addition to the cover 21, the dispensing facility 15 comprises a receiving part 23. The receiving part 23 can be a plastic component, in particular a plastic injection molded component.

The receiving part 23 can be recessed into the door 3 at least in sections or arranged on the inside of the door 3. The cover 21 can be pivotably mounted on the receiving part 23 so as to rotate about the axis of rotation 22. As previously mentioned, the cover 21 can alternatively also be mounted on the receiving part 23 in such a manner as to be sideward and vertically displaceable.

The receiving part 23 comprises a tub-shaped or trough-shaped receiving area 24 in which a cleaning agent 25 can be received primarily in tab or tablet form. When the cover 21 is opened with the door 3 closed, the cleaning agent 25 falls out of the receiving area 24 into the dishwasher interior 4, where it is dissolved in the rinsing liquor and/or fresh water. The receiving part 23 has a flange 26 which runs around the receiving area 24.

Moreover, the receiving part 23 comprises an upper edge 27, which is assigned to the upper edge 16 of the door, and a lower edge 28, which is assigned to the lower edge 17 of the door 3. The axis of rotation 22 can be provided on the upper edge 27, as shown in FIG. 3. However, the axis of rotation 22 can also be provided on the lower edge 28. The receiving part 23 has a first side edge 29, which is assigned to the first side edge 18 of the door 3, and a second side edge 30, which is assigned to the second side edge 19 of the door 3.

Figure 4:
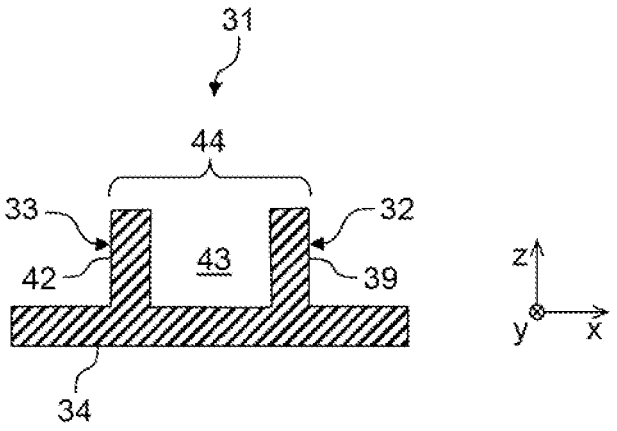
FIG. 4 shows a schematic part sectional view of an embodiment of a sealing arrangement for the dispensing facility according to the line of intersection IV-IV shown in FIG. 3.

Moreover, the dispensing facility 15 comprises a sealing arrangement 31 for sealing the cover 21 with respect to the receiving part 23. A part sectional view of the sealing arrangement 31 according to the line of intersection IV-IV shown in FIG. 3 is shown in FIG. 4.

The sealing arrangement 31 is produced from a flexible material, such as for example silicone, rubber, polyurethane, a thermoplastic elastomer (TPE), in particular a thermoplastic polyurethane (TPU). The material that is used for the sealing arrangement 31 can be foamed. The material can be compressible. The sealing arrangement 31 has a first sealing lip 32 and a second sealing lip 33. The sealing lips 32, 33 can be mutually connected with the aid of a connecting section 34 (FIG. 4). The connecting section 34 can lie against the flange 26 or rather can be connected thereto.

The first sealing lip 32 is different from the second sealing lip 33. "Different" is to be understood in the present case that the two sealing lips 32, 33 are two mutually separate areas or sections of the sealing arrangement 31. In other words, in particular the first sealing lip 32 and the second sealing lip 33 do not touch or contact each other. The sealing lips 32, 33 are mutually connected exclusively with the aid of a connecting section 34. This results in an interrupted or open sealing geometry or sealing contour of the sealing arrangement 31.

The sealing arrangement 18 can be a one piece, in particular a one-piece material, component. "One-piece" or "one-part" means in this case that the sealing lips 32, 33 and the connecting section 34 form a common component and are not made of different components. "One piece material" means in this case that the sealing arrangement 31 is produced continuously from the same material. The sealing arrangement 31 can be a plastic component, in particular a plastic injection molded component. The sealing arrangement 31 can be injected, for example, with the aid of a multi-component injection molded method, directly onto the receiving part 23.

The first sealing lip 31 extends in the x-direction x along the upper edge 27 and extends in part in the y-direction y along the side edges 29, 30. The first sealing lip 32 thus does not run completely around the receiving area 24 and also does not encompass it completely. The first sealing lip 32 thus has a circumferentially open sealing geometry or sealing contour. In contrast, the second sealing lip 32 extends in the x-direction x along the lower edge 28 and extends in part in the y-direction y along the side edges 29, 30. The second sealing lip 33 thus also does not run completely around the receiving area 24 and also does not encompass it. The second sealing lip 33 thus also has a circumferentially open sealing geometry or sealing contour.

The first sealing lip 32 and the second sealing lip 33 overlap in the region of the two side edges 29, 30 in each case in a first overlap area 35 and in a second overlap area 36 along the y-direction y. When viewed along the x-direction x, the second sealing lip 33 is arranged within the first sealing lip 32.

The first sealing lip 32 comprises a base section 37 that extends along the x-direction x and two leg sections 38, 39 which are provided at the end of the base section 37 and are oriented transversely, in particular perpendicular, to the base section 37 and run along the y-direction y. A first leg section 38 and a second leg section 39 are provided. The second sealing lip 33 also comprises a base section 40 that extends along the x-direction x and two leg sections 41, 42 which are provided at the end of the base section 40, are oriented transversely, in particular perpendicular, to the base section 40 and run along the y-direction y. A first leg section 41 and a second leg section 42 are provided.

The first leg sections 38, 41 overlap each other in the first overlap area 35. The second leg sections 39, 42 overlap each other in the second overlap area 36. "Overlap" in this case means that the leg sections 38, 39, 41, 42 are each arranged in pairs in such a manner that the leg sections 38, 39, 41, 42 overlap or cover each other when viewed along the x-direction x. In this case, the leg sections 41, 42 of the second sealing lip 33 are positioned between the leg sections 38, 39 of the first sealing lip 32 when viewed along the x-direction x. The first sealing lip 32 covers the second sealing lip 33 in a roof-shaped manner when viewed along the y-direction y.

The entire sealing arrangement 31 runs with its two sealing lips 32, 33 completely around the receiving area 24 and thus encompasses or delimits it completely. In this case, the sealing arrangement 31 is, however, circumferentially not closed but rather is interrupted or open at the overlap areas 35, 36. In contrast to the sealing arrangement 31, the two sealing lips 32, 33 themselves each do not completely run around the receiving area 24.

A hollow space, slit or gap 43 (FIG. 4), in particular an air gap, which separates the first sealing lip 32 from the second sealing lip 33, is provided between leg sections 38, 41 and the leg sections 39, 42 in the region of the overlap areas 35, 36 respectively. In this case, each pair of first leg sections 38, 41 and second leg sections 39, 42 is assigned such a gap 43.

The two sealing lips 32, 33, in particular the respective pair of first leg sections 38, 41 and second leg sections 39, 42, form at the overlap areas 35, 36 together with the gap 43 in each case a labyrinth seal 44 of the sealing arrangement 31. A "labyrinth seal" or "gap seal" is to be understood in the present case to be a non-contact seal in which the sealing lips 32, 33 do not touch each other and are therefore not in contact with each other.

The sealing effect of the labyrinth seal 44 is based on an extension of a flow path of a fluid, for example wash liquor and/or fresh water or a liquid cleaning agent, through the gap 43 that is to be sealed, which significantly increases the flow resistance for the fluid that is entering or leaving the dispensing facility 15. The extension of the flow path is achieved by an interlocking or an intermeshing of the two sealing lips 32, 33 as explained above. The two sealing lips 32, 33 are only interlocked in the overlap areas 35,36.

With the aid of the interrupted and flexible geometry of the sealing arrangement 31, the sealing function can be generated with consistently low operating forces. The sealing arrangement 31 acts in the area of the upper edge 27 of the dispensing facility 15 and at the side edges 29, 30 against wash liquor and/or fresh water penetrating from above in the orientation shown in FIG. 3. In the area of the lower edge 28 and the side edges 29, 30, the sealing arrangement 31 acts against leakage of a liquid detergent (not shown) out of the receiving area 24.

At the side edges 29, 30, tightness is additionally ensured by the design of the sealing lips 32, 33 in the form of the labyrinth seal 44. The sealing lips 32, 33 are pushed or compressed laterally against a sealing geometry (not shown). The sealing lips 32, 33 are designed to be so flexible that they can be deformed without great forces. In the closed state Z1, the sealing arrangement 31 is thus compressed between the receiving part 23 and the cover 21.

Advantageously, by using the sealing arrangement 31 in comparison to a sealing arrangement without the previously explained sealing lips 32, 33, greater compensation of component and manufacturing tolerances of the cover 21, the receiving part 23 and/or the sealing arrangement 31 is possible with the same or lower operating forces. As a result, a better sealing function of the entire dispensing facility 15 can be achieved both against the ingress of liquid from outside and also against a loss of cleaning agent 25 from the receiving area 24.

In contrast, a leaky dispensing facility can lead to the cleaning agent 25 being activated earlier than desired, so that components of the cleaning agent 25 can react early and thus lose their effect. If the cleaning agent 25 is already wetted in the receiving area 24 due to a leak, it tends to clump together, which can lead to blockage of the cover 21 when it is opened. This is reliably prevented with the aid of the dispensing facility 15, which has the sealing arrangement 31.

Pre-dosing of a liquid detergent can be made possible by suitably positioning an aeration opening on the dispensing facility 15. The position of the labyrinth seal 44 or the overlap areas 35, 36 when viewed along the y-direction y can also be used to vary the volume of a pre-dosing or a remaining amount of cleaning agent. Due to the flexibility of the sealing lips 32, 33, the risk of the sealing arrangement 31 sticking together due to frictional forces is prevented. The use of the sealing arrangement 31 can also open up further degrees of freedom in terms of energy saving, which cannot be realized with known dispensing facilities.

For example, shortening the post-wash time has so far led to an extension of the pre-wash phase. This extension is not readily possible with a leaky dispensing facility, since the cleaning agent 25 reacts with the wash liquor and/or fresh water in advance and, in the worst case, can lead to a blockage of the cover 21. This disadvantage can also be remedied with the aid of the dispensing facility 15, which has the sealing arrangement 31.

Although the present invention has been described with the aid of exemplary embodiments, it can be modified in many ways.

The invention claimed is:

1. A household dishwasher, comprising:

a dishwasher cavity encompassing a dishwasher interior;

a dispensing facility designed to dispense a cleaning agent into the dishwasher interior, said dispensing facility comprising a receiving part including a receiving area for receiving the cleaning agent;

a cover designed to seal the receiving area; and a sealing arrangement having at least one section arranged between the receiving part and the cover, said sealing arrangement including a first sealing lip and a second sealing lip that is different from the first sealing lip, said sealing arrangement designed to run completely around the receiving area, with the first sealing lip running only partially around the receiving area, and the second sealing lip also running only partially around the receiving area, wherein each of the first sealing lip and the second sealing lip has a U-shape, and wherein a first edge of the first sealing lip overlaps a second edge of the second sealing lip such that the first sealing lip is positioned at least partially within the second sealing lip.

2. The household dishwasher of claim 1, wherein the first sealing lip and the second sealing lip overlap each other in an overlap area when viewed in a transverse direction.

3. The household dishwasher of claim 2, wherein the overlap area is arranged in a variable manner.

4. The household dishwasher of claim 2, wherein the first sealing lip is wider than the second sealing lip when viewed along the transverse direction.

5. The household dishwasher of claim 2, wherein the second sealing lip has at least one section arranged within the first sealing lip when viewed along the transverse direction.

6. The household dishwasher of claim 5, wherein the first sealing lip includes a base section which extends along the transverse direction, a first leg section, which extends transversely to the base section, and a second leg section, which also extends transversely to the base section, and wherein the second sealing lip includes a base section which extends along the transverse direction, a first leg section, which extends transversely to the base section, and a second leg section, which also extends transversely to the base section.

7. The household dishwasher of claim 6, wherein the first and second leg sections of the second sealing lip are arranged between the first and second leg sections of the first sealing lip when viewed along the transverse direction.

8. The household dishwasher of claim 6, wherein the first leg section of the first sealing lip and the first leg section of the second sealing lip have at least one overlapping section when viewed along the transverse direction, and wherein the second leg section of the first sealing lip and the second leg section of the second sealing lip have at least one overlapping section when viewed along the transverse direction.

9. The household dishwasher of claim 1, wherein the first sealing lip covers the second sealing lip in a roof-shaped manner when viewed along a vertical direction.

10. The household dishwasher of claim 1, wherein the sealing arrangement includes a gap arranged at least in one section between the first sealing lip and the second sealing lip.

11. The household dishwasher of claim 10, wherein the gap is an air gap.

12. The household dishwasher of claim 10, wherein the first sealing lip, the second sealing lip and the gap together form a labyrinth seal of the sealing arrangement.

13. The household dishwasher of claim 1, wherein the first sealing lip and the second sealing lip have each a U-shaped geometry, with the first sealing lip and the second sealing lip being arranged in such a manner that the U-shaped geometries of the first and second sealing lips are arranged inversely and have at least one section arranged one inside the other.

14. The household dishwasher of claim 1, wherein the cover is mounted on the receiving part in such a manner that the dispensing facility is movable from a closed state into an open state and conversely, said sealing arrangement being compressed between the receiving part and the cover in the closed state.

15. The household dishwasher of claim 1, wherein the sealing arrangement includes a connecting section designed to connect the first sealing lip to the second sealing lip in one piece.

16. The household dishwasher of claim 1, further comprising a door attached to the dishwasher cavity, said dispensing facility being attached to the door facing the dishwasher interior.

17. The household dishwasher of claim 16, wherein the dispensing facility protrudes at least in part into the dishwasher interior when the door is in a closed state.

* * * * *